US005272420A

United States Patent [19]

Nuckolls

[11] Patent Number: 5,272,420

[45] Date of Patent: Dec. 21, 1993

[54] BIASING SYSTEM FOR REDUCING ION LOSS IN LAMPS

[76] Inventor: Joe A. Nuckolls, 2500 Plymouth St., Blacksburg, Va. 24060

[21] Appl. No.: 740,643

[22] Filed: Jul. 31, 1991

Related U.S. Application Data

[63] Continuation of Ser. No. 500,886, Mar. 28, 1990, abandoned.

[51] Int. Cl.[5] ..... H01J 11/04

[52] U.S. Cl. ..... 315/326; 315/335; 313/634

[58] Field of Search ..... 315/326, 352, 272, 60, 315/268, 171, 175, 176, 358, 335, 25, 203, 204, 339; 313/25, 634, 635, 607, 113

[56] References Cited

U.S. PATENT DOCUMENTS

| | | | |
|---|---|---|---|
| 2,752,531 | 6/1956 | Westberg | 315/335 |
| 3,995,928 | 12/1976 | Shaffner et al. | 315/60 |
| 4,281,274 | 7/1981 | Bechard et al. | 315/49 |
| 4,488,091 | 12/1984 | Muzeroll et al. | 315/268 |
| 4,491,766 | 1/1985 | Larson | 315/60 |
| 4,625,141 | 11/1986 | Keeffe et al. | 313/25 |
| 4,678,960 | 7/1987 | Reiling | 313/25 |
| 4,899,090 | 2/1990 | Yoshiike | 315/335 |

*Primary Examiner*—Eugene R. LaRoche
*Assistant Examiner*—A. Zarabian

[57] ABSTRACT

A high intensity discharge lamp system includes an AC supply for a chamber within which a plasma conductor is created to generate light. In order to confine charged particles within the chamber and to inhibit migration and loss thereof, a DC circuit taps power from the AC supply and produces a DC potential which is applied to relatively large-surface components in the vicinity of the plasma chamber. Properly polarized, the large-surface components, such as a reflector and a conductive housing, refractor or door, produces electric fields which inhibit migration of the charged particles. The result is improved color and light output as well as increased lamp life.

22 Claims, 4 Drawing Sheets

BIASING SYSTEM FOR REDUCING ION LOSS IN LAMPS

This is a continuation of application Ser. No. 500,886, filed Mar. 28, 1990, abandoned.

This invention relates to luminaire and ballast circuit techniques for minimizing the loss of plasma chemicals and ions from the confining arc tube of an energized plasma in a high intensity discharge lamp.

BACKGROUND OF THE INVENTION

It has been recognized for many years that sodium ions in high pressure sodium (HPS) lamps, as well as ions of other elements in other lamp types, are lost by the migration of those ions through the walls of the arc-containing media in which the ionized gases are confined under electrically energized and operating conditions. The basic problem has been discussed in texts as well as some prior patents. Metals, such as sodium, which are placed within the lamps and are evaporated and driven into a gas discharge are essential for the creation and maintenance of an ionized plasma conductor which creates the light output produced by the lamp. Each type of lamp is produced with a fill or starting gas, with certain amounts of metals, halides and amalgam, and frequently with a mixture of elements, each to be operated at a selected partial vapor pressure magnitude, so that the light output will have the desired color spectrum and lumen output level when it is appropriately electrically energized. Clearly, when plasma materials escape from the discharge lamp as a result of the ion loss, the characteristics of the lamp deteriorate with color shifts and fall-off of lumen output level and are no longer in accordance with the design and operating characteristics desired. In addition, the useful life of the lamp is shortened considerably because of the drops in lamp performance and because the lamp operating voltage rises which results in undesired electrical operating changes.

While certain proposals have been advanced to mitigate this loss, a practical, effective and economical solution to the problem has not been found. Sodium loss is one of the major causes of high intensity discharge performance fall-off with operating time.

SUMMARY OF THE INVENTION

An object of the present invention is to provide an electrical system to reduce the loss of gas ions from lamp structures in a luminaire.

A further object is to provide a circuit which is simple and inexpensive, which operates effectively and which, in conjunction with the ballast and fixture, can be provided for lamps and ballasts of a wide variety of types and sizes.

Briefly described, the invention comprises an electrical system for inhibiting ion loss from a plasma conductor in a high intensity discharge lamp. The lamp includes an arc tube chamber for containing an ionizable fill gas and plasma materials including a metal halide which when evaporated and in discharge contribute to the formation of a plasma conductor, the arc tube chamber having electrical terminals. First circuit means including a ballast provides AC operating voltage to the terminals of the arc tube chamber. An electrically conductive surface substantially surrounds and encloses the arc tube chamber. Second circuit means is connected to a voltage, source for developing a DC potential, the second circuit means having positive and negative output terminals. Third circuit means connects one of the DC output terminals to one or both of the electrical terminals of the arc tube. The other of the DC output terminals is connected to the conductive surface enclosing the arc tube to establish an electric field between the surface and the arc tube thereby to confine in the chamber those ions having the same polarity as the surface.

Preferably, the electrically conductive surface includes a reflector normally used physically close to the lamp and, in a fixture having a transparent light window surface near the lamp but on the opposite side thereof from the reflector, a second conductive surface comprising a substantially transparent thin film on the glass or plastic window can be provided to establish a lamp-enclosing electric bias voltage field. Other conductive parts of the fixture housing can also be used as bias-producing conductive surfaces but the physically close reflector has the greatest impact. Some luminaires have a primary reflector placed in front of the lamp and a larger secondary reflector placed behind the lamp. Each of these reflectors can provide bias surfaces.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification, and wherein.

DESCRIPTION OF THE PREFERRED EMBODIMENTS

Figure 1:
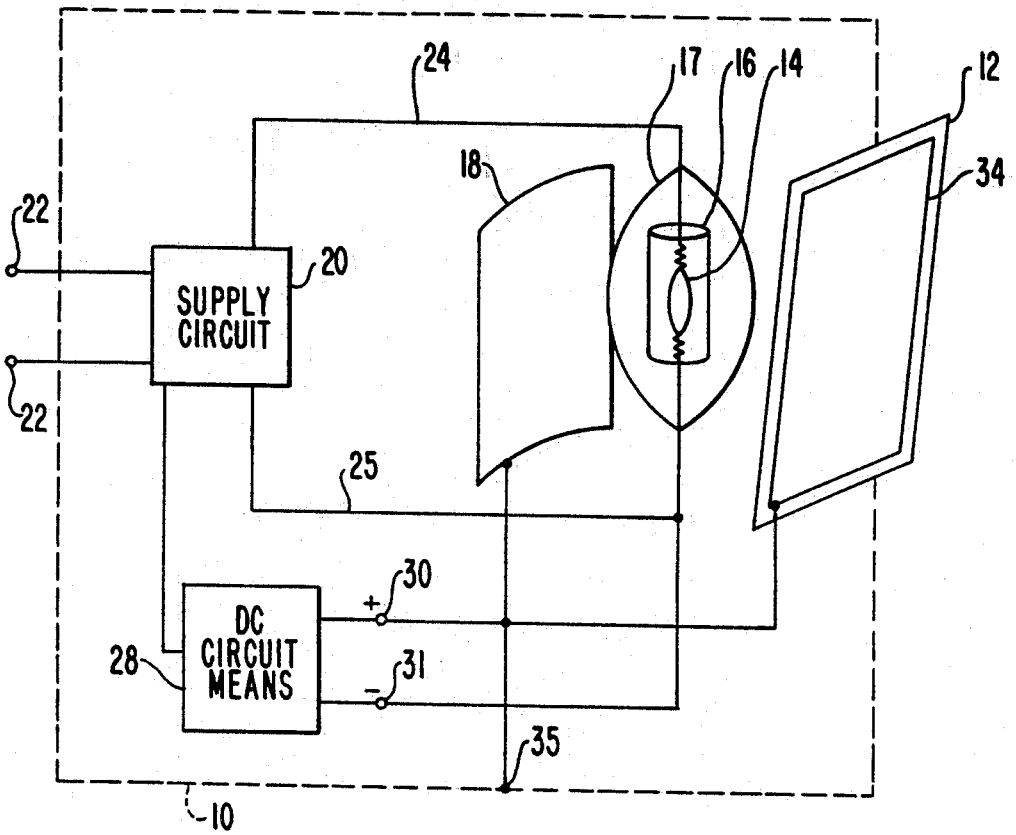
FIG. 1 is a schematic diagram of a luminaire including a plasma conductor chamber therein illustrating the principle of the invention.

FIG. 1 illustrates, in a simplified form, the interconnection of major components of the apparatus in accordance with the invention. The invention will be described in the context of a luminaire having a high pressure sodium or metal halide light source therein. It should be emphasized, however, that a variety of types of lighting fixtures can benefit from the invention and that a variety of other types of discharge lamps using gases other than sodium are usable with the invention.

The luminaire of FIG. 1 has a housing, schematically indicated at 10, having a transparent portion 12 which can be a refractor or an openable access door typically having a glass panel therein. The light source itself includes a plasma conductor 14 formed within a chamber such as an arc tube 16 which contains an ionizable gas and which can be surrounded by an outer jacket or envelope 17. The lamp may, however, not have an outer jacket as is the case with many double-ended lamps. The shapes and sizes of these components are variable with the type of lamp and the manufacturer. A reflector 18 is schematically illustrated as being on the opposite side of the light source from the door or refractor 12 and, as is commonly the case, can be curved to direct light from a portion of the source to create a particular light output pattern as well as to enclose the light source.

A supply circuit has terminals 22 which are connectable to a standard AC source of voltage. Supply circuit 20 provides an AC output on conductors 24 and 25 which are connected to the lamp terminals at opposite ends of chamber 14. A DC circuit 28 is conveniently powered from the supply circuit 20 and produces a DC potential at output terminals 30 and 31 which are positive and negative, respectively. In the embodiment shown, which involves a sodium vapor plasma conductor 14 in chamber 16, the positive terminal of DC circuit 28 is connected to reflector 18 and negative terminal 31 is connected to the arc tube at one end of the plasma conductor.

In the operation of the simple circuit of FIG. 1, the AC supply circuit 20 provides AC operating current on lines 24 and 25 into the ends of arc tube chamber 16 to the plasma conductor in chamber 16, maintaining the plasma in a condition to create light which passes through door or refractor 12. The light is directed or focused by reflector 18. At the same time, DC potentials are placed on the reflector and the plasma conductor causing the reflector to be positive with respect to the plasma. Because the plasma contains sodium ions which have positive charges, a positive potential with respect to the plasma conductor is placed on reflector 18, causing an electric field between the reflector and the plasma ions which tends to repel the positively charged plasma particles away from the reflector and which thereby helps confine those particles within chamber 16. This electric field significantly reduces the amount of migration of these positive ions through the walls of arc tube 16, lengthening the life of the tube and maintaining the sodium design balance, thus improving the color and light output thereof for an extended interval of time.

The operation of the apparatus of FIG. 1 is improved by adding an electrically conductive coating 34 to a surface of door or refractor 12 and connecting positive terminal 30 to coating 34. The result of this arrangement is to completely enclose the plasma in a repelling electric field from all sides of the light source, enhancing the confinement of ions within the plasma body and further improving and lengthening the operation thereof.

FIG. 1 also shows the connection 35 of the positive terminal of the DC source to fixture housing 10. The housing is made partly or entirely of metal or, if not, can be made partially electrically conductive by the addition of a conductive film or filler. By connection 35 to this conductive region, the entire housing 10 can be used to enhance the field which aids in confinement of the ions in chamber 16.

Of particular importance is the provision of a surface or surfaces substantially surrounding and enclosing the lamp and the development on those surfaces of a potential which repels and confines ions in the arc tube chamber. This is accomplished without adding devices inside of the structure of the lamp itself which is an expensive and undesirable approach. It will be apparent that when extra devices are included in the lamp outer jacket, they are necessarily thrown away with the lamp when its useful life has ended, but circuitry added to the luminaire structure remains and is effective to lengthen the life of every lamp installed therein.

Figure 2:
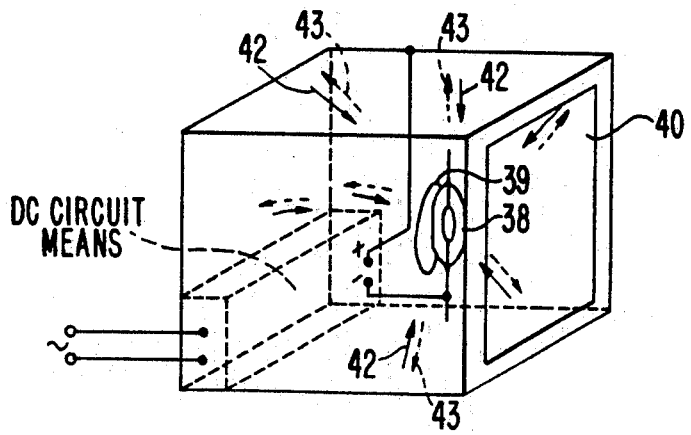
FIG. 2 is a diagram of the bias voltage fields produced in a typical luminaire structure in accordance with the invention.

FIG. 2 schematically illustrates the relationship between a light source 38, a reflector 39, a refractor 40 and an enclosing housing 41 where the reflector is metal or has a metallized surface and the refractor 40 also has a metallized surface, both of these components and the conductive housing 41 being connected to the positive terminal of DC source 28 while the negative terminal thereof is connected to the plasma conductor light source. Again, assuming a sodium vapor lamp, a three-dimensional field 42 is produced between the plasma conductor and the surrounding shell-like bodies which is extremely effective in confining the plasma components within their containing chamber. Because the bodies themselves substantially surround or enclose the light source, the confining effect is considerable. The geometric relationship illustrated is commonly arranged as shown in FIG. 2 for optical reasons but has not been employed for electric field reasons or for the confinement of ions in a plasma stream heretofore.

Figure 3:
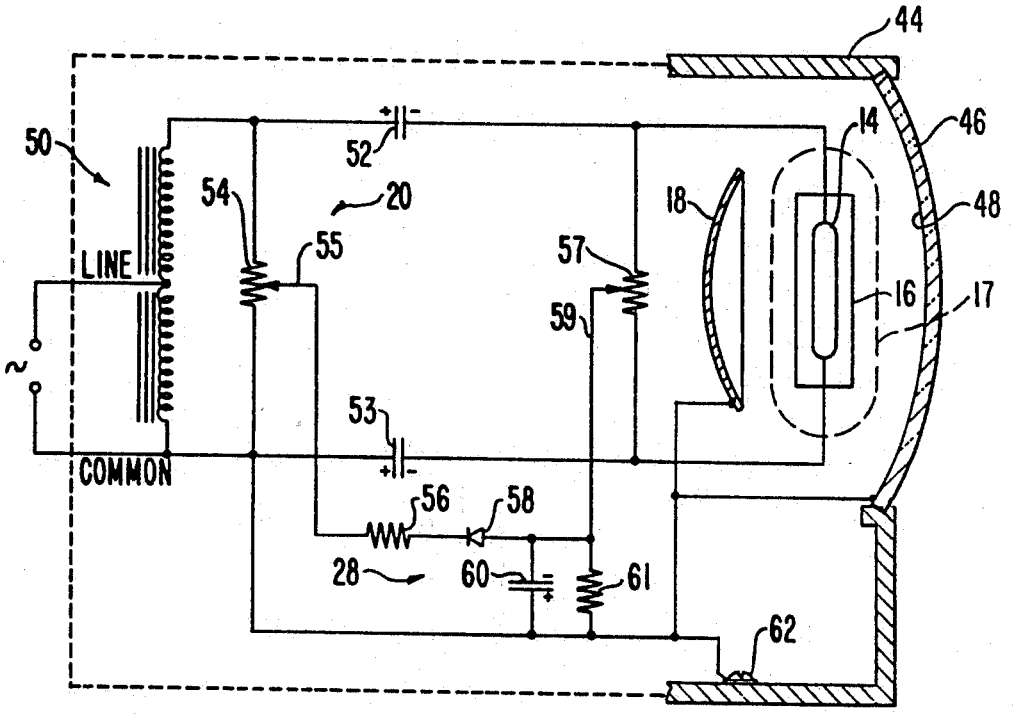
FIG. 3 is a schematic diagram of a first embodiment of a luminaire including a system in accordance with the invention.

The application of this principle to one form of luminaire is shown in FIG. 3 wherein the components of the luminaire are largely contained within a housing 44. Housing 44 is either metal, filled with metal particles or is coated with a metallized surface. The housing includes an opening which receives a glass or plastic refractor 46 having a conductive coating 48 on the inner surface thereof. Coating 48 can be, for example, a thin layer of tin oxide or indium oxide which leaves the refractor substantially transparent but which renders the inner surface thereof electrically conductive. Such a layer can be placed on glass by conventional deposition techniques.

Behind the refractor 46 is a plasma chamber 16 surrounded by an outer jacket 17 and behind this light source is a reflector 18.

An AC supply circuit indicated generally at 20 includes a conventional metal halide lamp ballast indicated at 50, the ballast typically being a constant wattage auto-transformer or peak lead autoregulator with the tap and common points arranged for connection to an AC source. The usual single ballast capacitor, which would be connected in series between the ballast transformer and the plasma chamber, is replaced by two ballast capacitors 52 and 53 which are connected in series with the two AC lines leading from the ballast transformer to the light source. In order for the lamp operating wattage to be correct, each of capacitors 52 and 53 is selected to have a value of twice the capacitance of the single series capacitor which would normally be used with the ballast transformer. These capacitors provide isolation for the light source so that a DC bias can be placed thereon.

A voltage divider means includes a potentiometer 54 connected across the output of transformer 50 with the movable contact 55 being connected to the DC circuit means 28. Contact 55 is connected through a series resistor 56 and diode 58 to the parallel connection of a capacitor 60 and a resistor 61. The other side of the parallel circuit is connected to the common line which is also connected to conductive housing 44 at a screw terminal 62.

The positive output terminal of this DC circuit, which is the common line, is also connected to reflector 18 and conductive coating 48 on the refractor. The negative side is connected to the movable contact 59 of a potentiometer 57. The ends of the potentiometer are connected to the terminals of the plasma conductor chamber. The resulting field tends to confine positive ions in chamber 16, inhibiting migration thereof through the walls of the chamber. Because the positive terminal is connected to the housing at terminal 62, the housing itself, which is made of conductive material, can participate in creation of the confining field.

As previously indicated, this apparatus as illustrated in FIG. 3 can be used without coating 48, relying upon the field produced by physically close reflector 18 and the housing. As suggested by FIG. 2, reflector 18 can be formed as a shell-like structure to more fully enclose the chamber and improve the effect of the confining field.

It should also be noted that the reversal of diode 58 causes reversal of the DC field so that either positive or negative ions can be confined using essentially the same circuit, the choice being made on the basis of the type of lamp and the ions or chemicals used therein.

Figure 4:
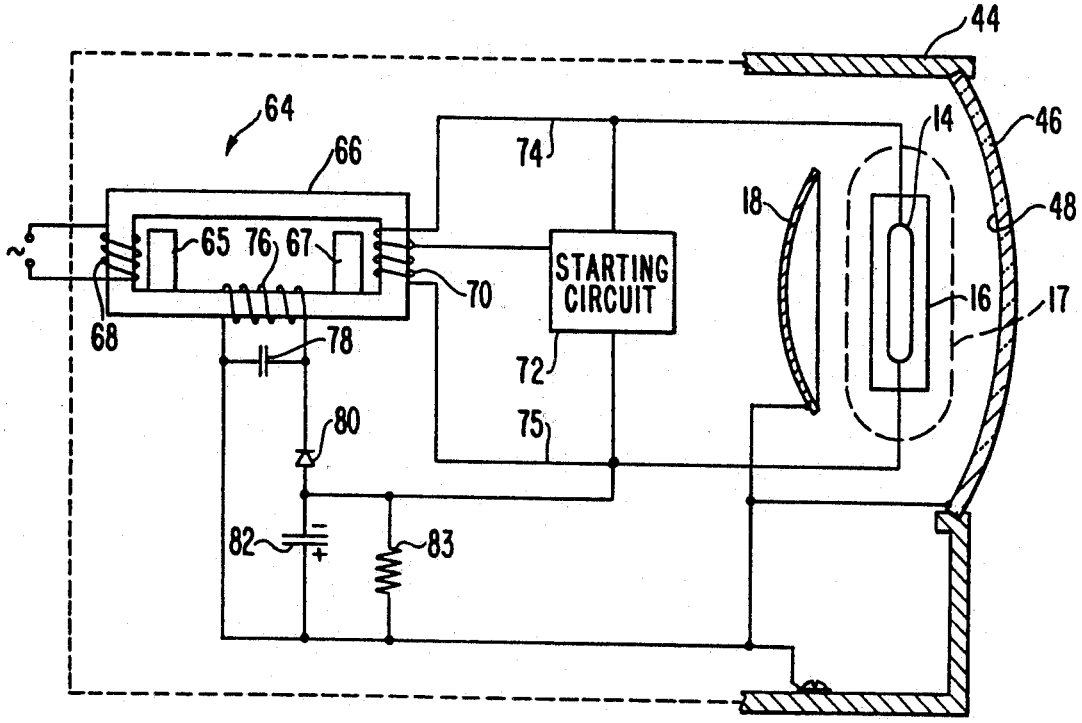
FIG. 4 is a schematic diagram of a further embodiment of a luminaire incorporating the system of the present invention.

A circuit which uses an electromagnetic regulator is illustrates in FIG. 4. Many of the components including the housing, refractor, reflector and light source are the same as in FIG. 3 and are similarly numbered. The AC supply circuit indicated generally at 64 includes a magnetic regulator having a core 66 with three windings all of which are electrically insulated from the core and from each other. An isolated primary winding 68 is connectable to a conventional AC source. An output winding 70 is connected at its ends to chamber 14 and is tapped for connection to a starting circuit 72. Starting circuit 72 can be any of a variety of starting circuits which are now conventional in this art, using a discharge circuit to provide voltage pulses across the smaller, upper portion of winding 70 which is magnified by the auto transformer effect in winding 70 to provide a relatively high voltage pulses across conductors 74 and 75 for application to the deionized lamp to effect ignition. A suitable starting circuit is shown, for example, in FIG. 2 and other figures of U.S. Pat. No. 4,763,044, Nuckolls et al. Magnetic shunts 65 and 67 extend across windings 68 and 70.

A separate floating ballast capacitor winding 76 is provided with a shunt capacitor 78 which performs the ballast capacitor function. This separate ballast winding does not interfere with the electrical isolation of the primary winding and does not interfere with the normal AC operation of the ballast-lamp system. Winding 70 is connected through a diode 80 to a capacitor 82 across which the DC bias voltage appears for connection to the light system components. A bleeder resistor 83 is connected in parallel with capacitor 82. In the embodiment shown, intended for use with a sodium vapor lamp, the negative terminal of this DC supply is connected to common line 75 and to the plasma conductor chamber 16. The positive terminal is connected to reflector 18, conductive coating 48 and the conductive housing 44. The function is the same as in connection with the other embodiments discussed above in which a field is produced between the reflector, the refractor and the plasma conductor chamber to confine gases and ions therein.

These biasing techniques permit lamp design changes such as increased arc tube wall loading (watts per square cm.) with quartz and polycrystalline alumina to generate higher lumen-per-watt (L.P.W.) output and better color and other characteristics without the normal increase in the rate of sodium loss from the plasma and arc tube.

Figure 5:
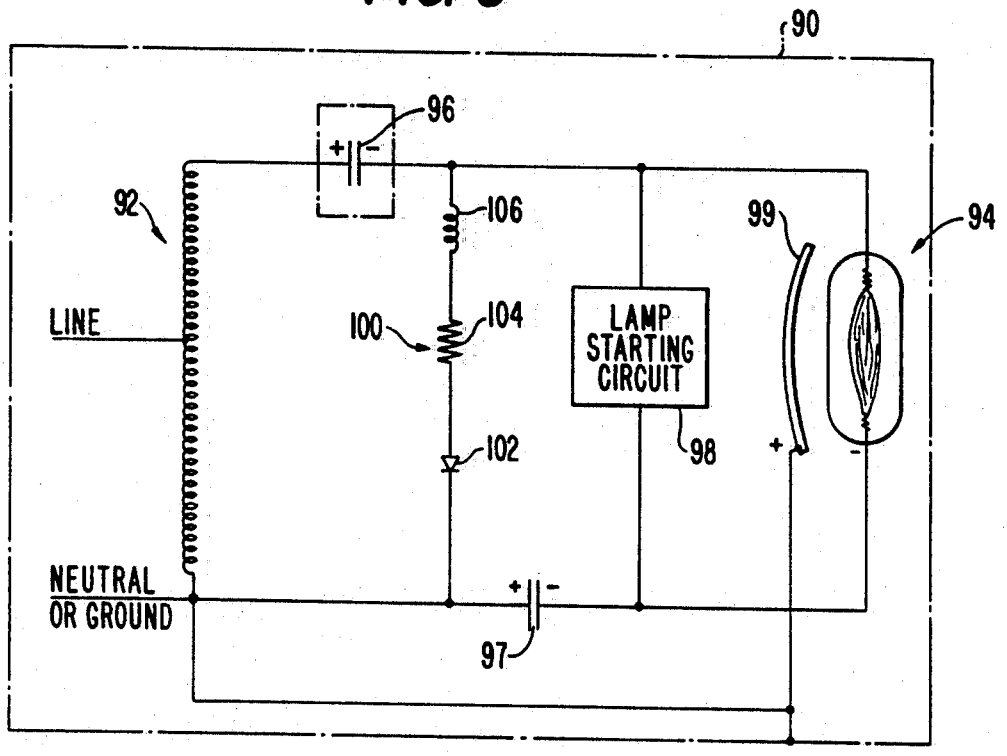
FIG. 5 is a schematic circuit diagram of another embodiment of a luminaire incorporating a system in accordance with the invention.

FIG. 5 shows a still further embodiment of a plasma-combining circuit apparatus in accordance with the invention which is particularly simple and therefore economically advantageous as well as being effective. In a manner similar to the embodiment of FIG. 3, an auto-transformer 92 is connected to a AC source and supplies AC current to a lamp indicated generally at 94 through series capacitors 96 and 97. A lamp starting circuit 98 is connected between the lamp sides of capacitors 96 and 97. A reflector 99 is positioned to reflect the light produced within lamp 94.

A DC circuit indicated generally at 100 includes the series connection of a diode 102 and a resistor 104 with the addition of a radio frequency choke 106 which is included to block high frequency, high voltage pulses from the lamp starting circuit. The diode is polarized so that the inductive ballast side of capacitor 97 is positive relative to the lamp side of the capacitor, and the polarization of capacitor 96 is also such that the inductive ballast side of the capacitor is positive with respect to the lamp side. Capacitor 96 is dielectrically insulated from the housing of the fixture. Finally, a conductor 108 interconnects the neutral or ground side of the line at inductor 92 to the reflector and also to the lamp housing 90.

With this circuit, the neutral side of the inductive ballast is positive with respect to the lamp as well as the lamp circuitry on the lamp side of capacitors 96 and 97. Thus, the plasma conductor itself is negative with respect to the reflector and the housing, again producing the ion migration-inhibiting field which improves lamp operation and lengthens life. Electrical isolation of capacitor 96 from the fixture housing by dielectric insulation prevents the high frequency, high voltage lamp ignition pulses from circuit 98 from being capacitively shorted out. The ballast secondary coil serves as an inductance which holds off the starting pulses from the starter circuit. The charging network comprising diode 102, resistance 104 and the choke charges the ballast capacitor 96 with the polarity shown. When the lamp strikes and draws high AC lamp current, part of the charge on capacitor 96 is conducted to ballast capacitor 97 until their DC voltages are equal and opposite so that the net DC voltage around the lamp power loop is zero. However, the lamp plasma circuit is biased negatively with respect to the neutral or metal parts.

The AC voltage swings across the operating lamp in this circuit are allowed to have a peak amplitude approaching or nearly equal to the DC biased voltage. Thus, there exists very little if any voltage time in a half cycle in which a reverse-bias exists and which would tend to drive sodium ions through the walls of the arc tube.

The DC voltage is self-adjusting by the lamp voltage clamping mechanism in this circuit. Note that two of these charging networks 100 could be used, but it is not necessary because the AC power operation carries the required charge from one capacitor to the other.

Resistor 104, typically having a value of 10K ohms, 1 watt, is used to limit the charging circuit current. As previously indicated, the RF choke tends to block the high voltage from the starter, allowing the high frequency, high voltage to raise and ignite the lamp and also keeping the high voltage from damaging other charging circuit components. The diode, of course, allows the half-wave DC charging to take place.

If discharging of the ballast and starter capacitors are required when the ballast is deenergized, high resistance bleeder resistors can be connected across those capacitors. Rapid discharging, if desired, can be accomplished by connecting a small relay having individual normally closed contacts series connected with a small resistor across each capacitor, the relay coil being connected across the line or the ballast secondary.

Figure 6:
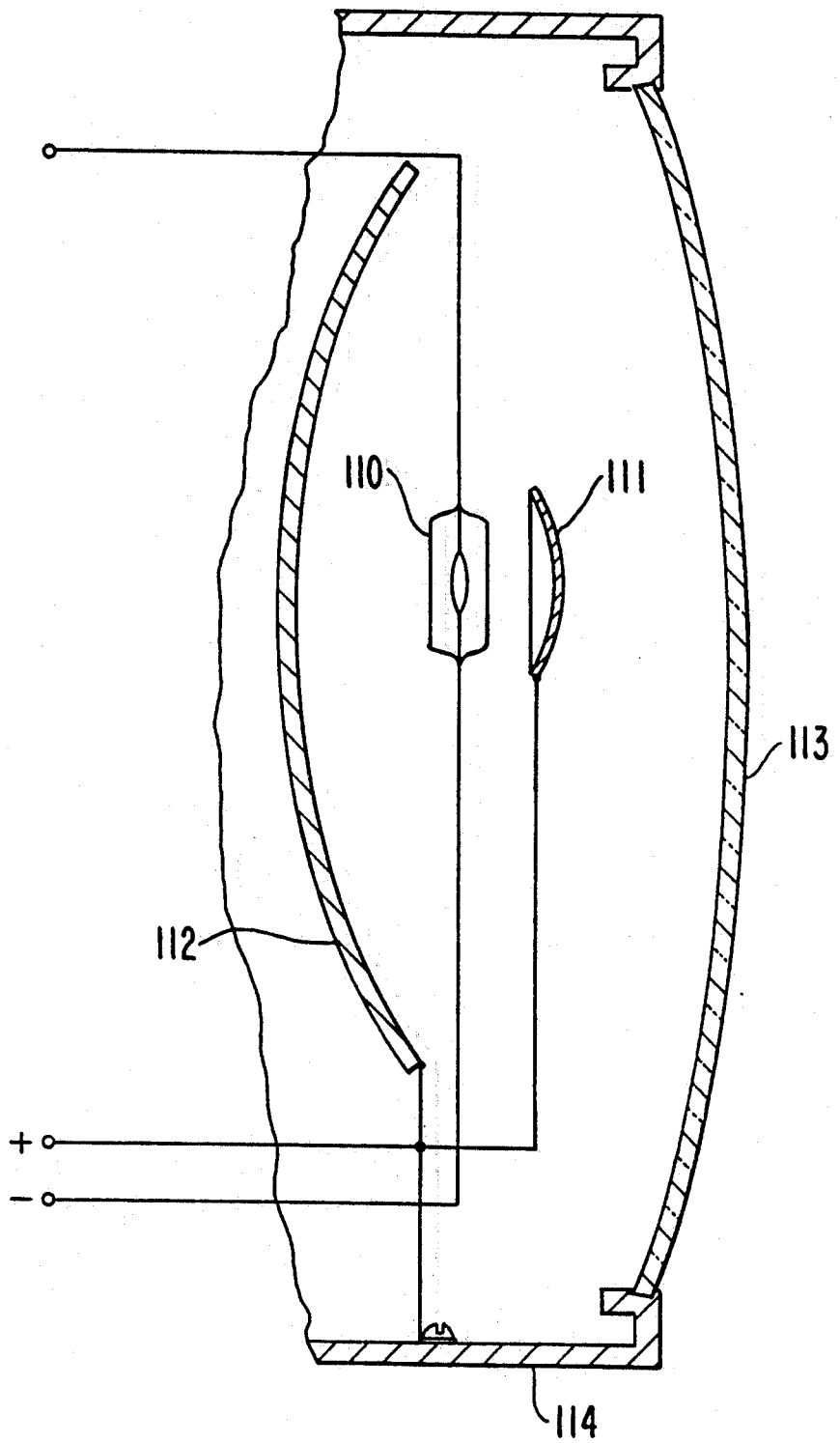
FIG. 6 is a schematic side elevation, in partial section, of a portion of a luminaire having primary and secondary reflectors usable in conjunction with the present invention.

FIG. 6 shows a reflector arrangement which can be used in conjunction with the present invention to considerable advantage. In some fixtures, the lamp 110 is positioned between a primary reflector and a secondary reflector 112. The two reflectors are used to project light from the lamp through refractor or cover 113 in a particular pattern. As before, these components are mounted in a housing 114.

By connecting one side of the DC supply to both reflectors and the other side of the supply to one or both terminals of the lamp, the reflectors form an enclosing field which is highly effective because the reflectors substantially enclose the lamp and are physically closer to the lamp than the remainder of the housing. Any of the circuit arrangements discussed herein can be applied to this reflector arrangement.

Figure 7:
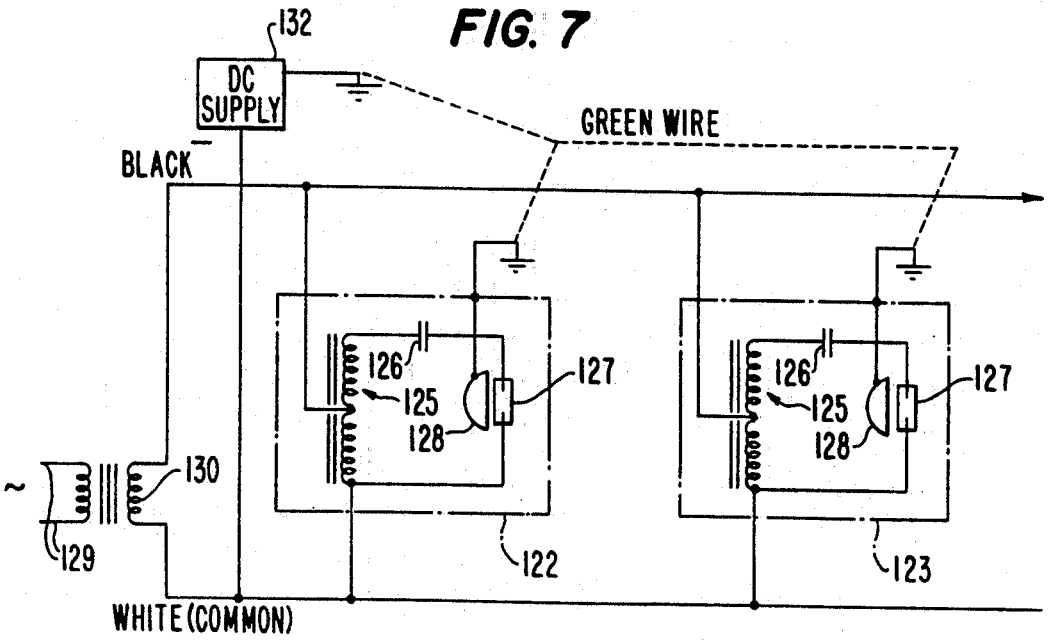
FIG. 7 is a schematic diagram of the application of the invention to a large number of lighting fixtures in a building.

The invention has thus far been described in the context of a single lighting fixture or luminaire. However, it is quite possible to apply the invention to all lighting fixtures of a similar type in an entire building. As will be recognized, this has advantages of economy. A technique for doing this is schematically illustrated in FIG. 7 wherein a building 120 has a large number of lighting fixtures, two of which are illustrated at 122 and 123. Each fixture typically has a ballast transformer 125 and a ballast capacitor 126 which can be arranged in a manner similar to the circuits illustrated in FIGS. 3 and 4 but need not be. Each fixture also has a lamp 127, such as a sodium vapor lamp, and a reflector 128. Starting circuit means can also be provided in or associated with the ballast circuitry.

The primary winding of an AC power and DC isolation transformer 130 is connected to the conventional AC lines feeding the building. The fixtures 122, 123, . . . are connected in parallel across the high and common terminals of the transformer secondary winding. In the particular embodiment of the fixtures shown, the primary portion of each fixture ballast transformer is connected thus to the AC supply.

A DC supply unit 132 is connected between the AC common line from the secondary of transformer 130 and building ground, i.e., the green wire in a three-wire electrical system, with the positive output terminal of the DC source being connected to building ground. This establishes a DC bias between the common line and building ground with ground being positive relative to the common line. In order to provide the desired bias to confine the material in the lamp in accordance with the invention, it is only necessary to connect the reflector and/or the housing of each fixture (depending upon the specific reflector and housing structures) to building ground. Since the plasma conductor is connected to the common AC line, it is automatically biased negative relative to ground. The reflector and/or housing is thus made positive relative to the plasma, creating the desired confining field. It is necessary to be sure that all wiring used for fixtures in this fashion are connected to the isolation transformer 130 if other AC supply cables are employed for other purposed in the building. A dedicated cable for this DC biasing is preferred.

While certain advantageous embodiments have been chosen to illustrate the invention, it will be understood by those skilled in the art that various changes and modifications can be made therein without departing from the scope of the invention as defined in the appended claims.

What is claimed is:

1. An electrical system for inhibiting ion loss from a plasma conductor in a high intensity discharge lamp comprising the combination of an arc tube chamber for containing an ionizable fill gas and plasma materials including a metal halide which when evaporated and in discharge contribute to the formation of a plasma conductor, said chamber having first and second terminals;

first circuit means including a ballast connected to said first and second terminals for providing AC operating voltage to said chamber;

an electrically conductive surface substantially surrounding and enclosing said chamber;

second circuit means connected to a voltage source for developing a DC potential, said second circuit means having positive and negative output terminals; and third circuit means for connecting one of said output terminals to a terminal of said chamber and the other of said output terminals to said conductive surface to establish an electric field between said surface and said chamber to thereby confine in said chamber ions having the polarity of said surface.

2. An electrical system according to claim 1 wherein said electrically conductive surface comprises an electrically conductive reflector positioned at one side of said chamber to direct light produced therein in a desired direction.

3. An electrical system according to claim 2 wherein said first circuit means includes inductive circuit means connectable to a source of AC power and having first and second conductors for supplying AC operating voltage to opposite ends of the chamber and for acting as an inductive ballast during operation;

first and second ballast capacitors connected in series circuit relationship with said first and second conductors, respectively; and voltage divider means connected to said inductive circuit means, said second circuit means being connected to said voltage divider means for developing said DC potential difference.

4. An electrical system according to claim 1 and further including a second electrically conductive on the opposite side of said chamber from said first conductive surface and wherein said third circuit means includes a connection of said second electrically conductive surface to said other of said output terminals with the first said electrically conductive surface.

5. An electrical system according to claim 4 which includes an at least partially transparent housing and wherein said first electrically conductive surface comprises an electrically conductive reflector positioned at one side of said chamber to direct light produced therein in a desired direction; and said second electrically conductive surface comprises an electrically conductive and substantially transparent film supported on a surface of said at least partially transparent housing on the opposite side of said chamber from said reflector.

6. An electrical system according to claim 5 wherein said at least partially transparent housing includes an electrically conductive outer housing for the lamp components and circuits, said outer housing comprising a transparent portion and said third circuit means includes a connection of said negative output terminal to said outer housing.

7. An electrical system according to claim 6 wherein said at least partially transparent housing supporting said conductive film comprises a light transmitting wall of said outer housing.

8. An electrical system according to claim 1 wherein said electrically conductive surface is curved to at least partially enclose said chamber.

9. An electrical system according to claim 1 wherein said first circuit means includes inductive circuit means connectable for acting as an inductive ballast during operation having a magnetically permeable core with a first winding connectable to a source of AC power, a second winding for supplying AC operating voltage to opposite ends of said chamber and a third winding; and a ballast capacitor connected across the ends of said third winding, said third winding being connected to said second circuit means for developing said DC potential.

10. An electrical system according to claim 9 wherein said electrically conductive surface comprises an electrically conductive reflector positioned at one side of said chamber to direct light produced therein in a desired direction.

11. An electrical system according to claim 10 and further including a second electrically conductive surface on the opposite side of said chamber from said first conductive surface and wherein said third circuit means includes a connection of said second electrically conductive surface to said other of said output terminals with the first said electrically conductive surface.

12. An electrical system according to claim 11 which includes an at least partially transparent housing and wherein said first electrically conductive surface comprises an electrically conductive reflector positioned at one side of said chamber to direct light produced therein in a desired direction; and said second electrically conductive surface comprises an electrically conductive and substantially transparent film supported on a surface of said at least partially transparent housing on the opposite side of said chamber from said reflector.

13. An electrical system according to claim 12 wherein said at least partially transparent housing includes an electrically conductive outer housing for the lamp components and circuits, said outer housing comprising a transparent portion and said third circuit means includes a connection of said negative output terminal to said outer housing.

14. An electrical system according to claim 12 wherein said at least partially transparent housing supporting said conductive film comprises a light transmitting wall of said outer housing.

15. An electrical system according to claim 1 wherein said voltage source includes said first circuit means.

16. An electrical system according to claim 1 wherein said first circuit means includes inductive circuit means connectable to a source of AC power and having first and second conductors for supplying AC operating voltage to opposite ends of the chamber and for acting as an inductive ballast during operation; first and second ballast capacitors connected in series circuit relationship with said first and second conductors, respectively;

and wherein said second circuit means includes a diode and resistor in series circuit relationship connected between the chamber side of said first ballast capacitor and the inductive ballast side of said second ballast capacitor, and said third circuit means includes a conductor between said inductive ballast side of said second capacitor and said conductive surface.

17. An electrical system according to claim 16 and further including a fixture housing for containing said lamp and said first, second and third circuit means, said fixture housing being at least partially electrically conductive; and means for electrically insulating at least said first ballast capacitor from said fixture housing.

18. An electrical system according to claim 17 wherein said third circuit means additionally connects said inductive side of said second capacitor to the electrically conductive parts of said fixture housing.

19. A method of inhibiting ion loss from a plasma conductor in a discharge lamp of the type comprising a chamber containing an ionizable gas which contributes to the formation of the plasma conductor, the chamber having first and second terminals, first circuit means connected to the first and second terminals for providing AC operating voltage to the chamber, and an electrically conductive surface in the vicinity of the chamber, comprising the steps of producing a DC potential having positive and negative outputs; and connecting one of an DC outputs having the opposite polarity from the ions of the plasma conductor to one of the first and second terminals of the chamber and the other of the DC outputs to the conductive surface to establish an electrical field between the surface and the chamber to thereby confine in the chamber ions having the polarity of the surface.

20. An apparatus for inhibiting ion loss from a discharge lamp comprising the combination of a chamber for containing an ionizable gas;

first circuit means connected to said chamber for providing AC operating voltage to said chamber;

an electrically conductive surface positioned adjacent said chamber;

second circuit means for developing a DC potential, said second circuit means having positive and negative output terminals; and third circuit means for connecting one of said output terminals to said chamber and the other of said output terminals to said conductive surface to establish an electric field between said surface and said chamber to thereby confine in said chamber ions having the polarity of said surface.

21. An electrical system for inhibiting ion through the wall of a discharge lamp comprising the combination of an arc tube chamber having a wall for containing an ionizable fill gas and plasma materials which contribute to the formation of a plasma conductor, said chamber having first and second terminals;

first circuit means including a ballast connected to said first and second terminals for providing AC operating voltage to said chamber;

an electrically conductive surface substantially surrounding an enclosing said chamber;

second circuit means connected to a voltage surface for developing a DC potential, said second circuit means having positive and negative output terminals; and third circuit means for connecting one of said output terminals to a terminal of said chamber and the other of said output terminals to said conductive surface to establish an electric field between said surface an said chamber to thereby control migration ions having one of said polarities through the wall of said chamber.

22. A system according to claim 21 wherein said lamp is a high intensity discharge lamp.

* * * * *